United States Patent [19]

Roth et al.

[11] 4,392,941

[45] Jul. 12, 1983

[54] RECOVERY OF BITUMEN FROM TAR SANDS SLUDGE USING ADDITIONAL WATER

[75] Inventors: Robert B. Roth, Woodlyn; Walter H. Seitzer, West Chester, both of Pa.

[73] Assignee: Suncor, Inc., Toronto, Canada

[21] Appl. No.: 272,616

[22] Filed: Jun. 11, 1981

[30] Foreign Application Priority Data

Jul. 28, 1980 [CA] Canada ..... 357137

[51] Int. Cl.[3] ..... C10G 1/00

[52] U.S. Cl. ..... 208/11 LE; 210/723; 210/728; 210/738

[58] Field of Search ..... 208/11 LE; 210/702, 210/703, 708, 712, 721, 723, 726–731, 738, 768, 800

[56] References Cited

U.S. PATENT DOCUMENTS

| | | | |
|---|---|---|---|
| 2,924,565 | 2/1960 | Stegemeier et al. | 208/11 LE |
| 3,487,003 | 12/1969 | Baillie et al. | 210/704 |
| 3,556,980 | 1/1971 | Clark et al. | 208/11 LE |
| 3,560,371 | 2/1971 | Kaminsky et al. | 208/11 LE |
| 3,846,276 | 11/1974 | Walker | 208/11 LE |
| 3,963,599 | 6/1976 | Davitt | 208/11 LE |
| 4,018,664 | 4/1977 | Bain et al. | 208/11 LE |
| 4,018,665 | 4/1977 | Anderson | 208/11 LE |
| 4,096,057 | 6/1978 | Porritt et al. | 208/11 LE |

FOREIGN PATENT DOCUMENTS

| | | | |
|---|---|---|---|
| 975696 | 10/1975 | Canada . | |
| 975697 | 10/1975 | Canada . | |
| 975698 | 10/1975 | Canada . | |
| 975699 | 10/1975 | Canada . | |
| 975700 | 10/1975 | Canada . | |
| 1100074 | 4/1981 | Canada | 208/11 LE |

*Primary Examiner*—Peter A. Hruskoci

*Attorney, Agent, or Firm*—J. E. Hess; Donald R. Johnson; Patric C. Baker

[57] ABSTRACT

A method is disclosed for the recovery of bitumen from a sludge. The sludge is diluted with water and subjected to high-shear agitation and aeration and the sludge settled to obtain an upper bitumen-containing froth layer and a lower sludge layer of reduced bitumen content. The recovery of bitumen is increased over that obtained with aeration and mixing with mild agitation or with aeration alone or with agitation alone.

3 Claims, 1 Drawing Figure

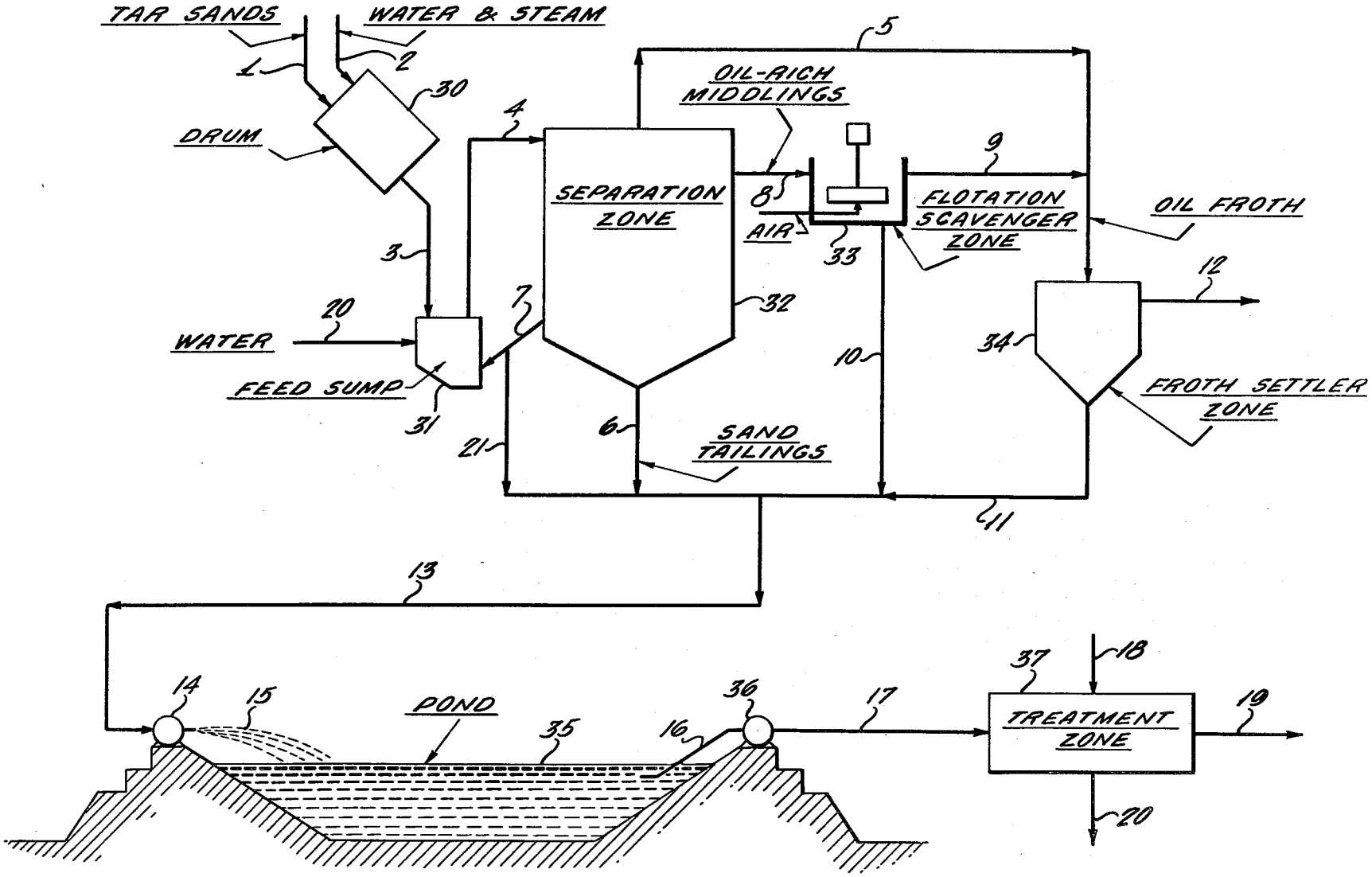
TAR SANDS
WATER & STEAM
DRUM
WATER
FEED SUMP
SEPARATION ZONE
OIL-RICH MIDDLINGS
AIR
FLOTATION SCAVENGER ZONE
OIL FROTH
FROTH SETTLER ZONE
SAND TAILINGS
TREATMENT ZONE
POND

RECOVERY OF BITUMEN FROM TAR SANDS SLUDGE USING ADDITIONAL WATER

BACKGROUND OF THE INVENTION

The present invention relates generally to an improvement in the recovery of bitumen from tar sands. The invention further relates to an improvement in the recovery of bitumen in water processes of extracting bitumen from tar sands. This invention particularly relates to the treatment of tailings discharged from a water extraction process and the treatment of tailings retained in a water storage retention pond. More particularly, this invention relates to a method of treating the sludge layer from a retention pond to recover bitumen froth therefrom using additional water.

Tar sands are also known as oil sands or bituminous sands. The sand deposits are found in numerous locations throughout the world, e.g., Canada, United States, Venezuela, Albania, Rumania, Malagasy and U.S.S.R. The largest deposit, and the only one of present commercial importance is in the northeast of the Province of Alberta, Canada.

Tar sand is a three-component mixture of bitumen, mineral and water. Bitumen is the component for the extraction of which tar sands are mined and processed. The bitumen content is variable, averaging 12 wt.% of the deposit, but ranging from 0 to 18 wt.%, and as used herein bitumen includes hydrocarbons. Water typically runs 3 to 6 wt.% of the mixture, increasing as bitumen content decreases. The mineral content constitutes the balance.

Several basic extraction methods have been known for many years for separating the bitumen from the sands. In a "cold-water" method, the separation is accomplished by mixing the sands with a solvent capable of dissolving the bitumen. The resulting mixture is then introduced into a large volume of water, water with a surface agent added, or a solution of a neutral salt in water. The combined mass is then subjected to a pressure or gravity separation.

The "hot water" process for primary extraction of bitumen from tar sands consists of three major process steps (a fourth step, final extraction, is used to clean up the recovered bitumen for further processing). In the first step, called conditioning, tar sand is mixed with water and heated with open steam to form a pulp of 70–85 wt.% solids. Sodium hydroxide or other reagents are added as required to maintain the pH in the range of about 8.0–8.5. In the second step, called separation, the conditioned pulp is diluted further so that settling can take place. The bulk of the sand-sized particles (greater than 325 mesh screen) rapidly settles and is withdrawn as sand tailings. Most of the bitumen rapidly floats (settles upward) to form a coherent mass known as bitumen froth which is recovered by skimming the settling vessel. An aqueous middlings layer containing some mineral and bitumen is formed between these layers. A scavenger step may be conducted in the middlings layer from the primary separation step to recover additional amounts of bitumen therefrom. This step usually comprises aerating the middlings. The froths recovered from the primary and scavenger step can be combined, diluted with naphtha and centrifuged to remove more water and residual mineral. The naphtha is then distilled for further processing. Hot water processes are described in U.S. Pat. Nos. 3,496,093; 3,502,566; 3,526,585; 3,502,565; 3,502,575; 3,951,800; 3,951,779; 3,509,641 and 3,751,358. Tailings can be collected from the aforementioned processing steps and generally will contain solids as well as dissolved chemicals. The tailings are collected in a retention pond in which additional separation occurs. The tailings can also be considered as processing water containing solids which are discharged from the extraction process. The tailings comprise water, both the natural occurring water and added water, bitumen and mineral.

The mineral particle size distribution is particularly significant to operation of the hot water process and to sludge accumulation. The terms sand, silt and clay are used in this specification as particle size designations. Sand is siliceous material which will not pass through a 325 mesh screen. Silt will pass through a 325 mesh screen but is larger than two microns and can contain siliceous material. Clay is smaller than 2 microns and also can contain siliceous material. The word fines as used herein refers to a combination of silt and clay.

Conditioning tar sands for the recovery of bitumen consists of heating the tar sand/water mixture to process temperature (180°–200° F.), physical mixing of the pulp to uniform composition and consistency, and the consumption (by chemical reaction) of the caustic or other added reagents. Under these conditions, bitumen is stripped from the individual sand grains and mixed into the pulp in the form of discrete droplets of a particle size on the same order as that of the sand grains. During conditioning, a large fraction of the clay particles becomes well dispersed and mixed throughout the pulp. The conditioning process which prepares bitumen for efficient recovery during the following process steps also prepares the clays to be the most difficult to deal with in the tailings disposal operation.

The other process step, called separation, is actually the bitumen recovery step, the separation having already occurred during conditioning. The conditioned tar sand pulp is screened to remove rocks and unconditionable lumps of tar sands and clay. The reject material, "screen oversize", is discarded. The screened pulp is further diluted with water to promote two settling processes. Globules of bitumen, essentially mineral-free, float upward to form a coherent mass of froth on the surface of the separation units; and, at the same time, mineral particles, particularly the sand size material, settle down and are removed from the bottom of the separation unit as sand tailings. These two settling processes take place through a medium called the middlings. The middlings consists primarily of water, bitumen particles and suspended fines.

The particular sizes and densities of the sand and of the bitumen particles are relatively fixed. The parameter which influences the settling processes most is the viscosity of the middlings. Characteristically, as the suspended material content rises above a certain threshold, which varies according to the composition of the suspended fines, viscosity rapidly achieves high values with the effect that the settling processes essentially stop. Little or no bitumen is recovered and all streams exiting the unit have about the same composition as the feed. As the feed suspended fines content increases, more water must be used in the process to maintain middlings viscosity within the operable range.

The third step of the hot water process is scavenging. The feed suspended fine content sets the process water requirement through the need to control middlings viscosity which, as noted before, is governed by the clay/water ratio. It is usually necessary to withdraw a drag stream of middlings to maintain the separation unit material balance, and this stream of middlings can be scavenged for recovery of incremental amounts of bitumen. Air flotation is an effective scavenging method for this middlings stream.

Final extraction or froth clean-up is usually accomplished by centrifugation. Froth from primary extraction is diluted with naphtha, and the diluted froth is then subjected to a two stage centrifugation. This process yields an oil product of essentially pure, but diluted, bitumen. Water and mineral and any unrecovered bitumen removed from the froth constitutes an additional tailing stream which must be disposed.

In the terminology of extractive processing, tailings are a throwaway material generated in the course of extracting the valuable material from the non-valuable material. And in tar sands processing tailings consist of the whole tar sand plus net additions of process water less only the recovered bitumen product. Tar sand tailings can be subdivided into three categories: (1) screen oversize; (2) sand tailings—the fraction that settles rapidly, and (3) middlings—the fraction that settles slowly. Screen oversize is typically collected and handled as a separate stream.

Tailings disposal is the operation required to place the tailings in a final resting place. Because the tailings contain bitumen emulsions, finely dispersed clay with poor settling characteristics and other contaminants, water pollution considerations prohibit discarding the tailings into rivers, lakes or other natural bodies. Currently the tailings are stored in retention ponds (also referred to as evaporation ponds) which involve large space requirements and the construction of expensive enclosure dikes. A portion of the water in the tailings can be recycled back into the water extraction process as an economic measure to conserve water. Currently two main operating modes for tailings disposal are (1) dike building—hydraulic conveying of tailings followed by mechanical compaction of the sand tailings fraction; and (2) overboarding—hydraulic transport with no mechanical compaction.

At one commercial location, for dike building, tailings are conveyed hydraulically to the disposal area and discharged onto the top of a sand dike which is constructed to serve as an impoundment for a pool of liquid contained inside. On the dike, sand settles rapidly and a slurry of water, silt, clay and minor amount of bitumen, as well as any chemical used during processing flows into the pond interior. The settled sand is mechanically compacted to build the dike to a higher level. The slurry which drains into the pond interior commences stratification in settling over a time scale of months to years. As a result of this long term settling, three layers form. The top layer, e.g., 5–10 feet of the pool, is a layer of relatively clear water containing minor amounts of solid, e.g., up to 5 wt.% and any dissolved chemicals. This layer of pond water can be recycled to the water extraction process without interfering with extraction of bitumen from tar sands. Below this clear water layer is a discontinuity in solid contents. Over a few feet, solids content increases to about 10–15 wt.% and thereafter, solids contents increase regularly toward the pond bottom. In the deeper parts of the pond, solid contents of over 50 wt.% have been measured. This second layer is commonly called the sludge layer. In general the sludge layer can be characterized as having more than 10 wt.% of solids (which is defined as mineral plus bitumen). More particularly, the sludge can be characterized as having 20 wt.% to 50 wt.% solids. Also the sludge can be characterized as having about 0.5 to about 20 wt.% bitumen. The solids contents of the sludge layer increase regularly from top to bottom by a factor of about 4–5. Portions of the solids are clays. The clays, dispersed by the processing, apparently have partially reflocculated into a fragile gel network. Through this gel, particles of larger-than-clay sizes are slowly settling. Generally this sludge layer cannot be recycled to the separation step because no additional bitumen is extracted. A third layer formed of sand also exists.

Overboarding is the operation in which tailings are discharged over the top of the sand dike directly into the liquid pool. A rapid and slow settling process occurs but this distinction is not as sharp as in the previously described dike building and no mechanical compaction is carried out. The sand portion of the tailings settles rapidly to form a gently sloping beach, extending from the discharge point toward the pond interior. As the sand settles, a slurry drains into the pool and commences long-term settling. Thus water in ponds prepared by both dike building and overboarding can be included in the general definition of sludge in the present description.

Methods for treating sludge formed in a retention pond used to store tailings from a hot water extraction of bitumen from tar sands are disclosed in Canadian Pat. Nos. 975,696; 975,697; 975,698; 975,699 and 975,700. The first mentioned Canadian Patent discloses removing sludge from a pond, placing the sludge in an air scavenger treating zone wherein the sludge is aerated and agitated concurrently, to form an upper bitumen froth layer and a lower tailings of water and mineral water. The lower tailings can be discharged into a retention pond. The upper bitumen froth is sent to a settling zone wherein two layers are formed, an upper bitumen layer reduced in mineral matter and water and a lower layer comprised substantially of mineral matter and water with minor amounts of bitumen. The latter lower layer is recycled back to the air scavenger treating zone while the upper bitumen layer is processed further to recover the bitumen. This Canadian patent and the others also disclose that sodium silicate can improve bitumen recovery when used in connection with the aeration and agitation. Canadian Pat. No. 975,697 discloses a process similar to that described in the previous patent with an additional step in that a portion of the lower layer, which otherwise would be recycled back to the air scavenger treating zone, is returned to the retention pond. Canadian Pat. No. 975,698 discloses feeding the sludge from a retention pond to an air pressure zone wherein the sludge is aerated at superatmospheric pressure to aerate bitumen in the sludge. Canadian Pat. No. 975,699 discloses feeding sludge recovered from a retention pond to a settling zone and permitting the sludge to form an upper froth layer and a lower tailings layer. Canadian Pat. No. 975,700 discloses feeding sludge to an air scavenger treating zone wherein the sludge is aerated and agitated concurrently and resulting froth is separated in the scavenger treating zone while the tailings are returned to the pond. However, none of the foregoing Canadian patents disclose or suggest diluting the sludge with water containing less than substantial amounts of mineral matter prior to aeration and agitation.

U.S. Pat. No. 4,018,664 discloses a method for treating sludge from a retention pond associated with hot water extraction of bitumen from bitumen sands. The method involves withdrawing sludge from a pond, diluting and mixing it with water, and settling to obtain a froth layer, a middle layer containing reduced solids and a lower layer containing increased solids over the original sludge. Agitation and/or aeration, for example, aeration sufficient to mildly agitate the sludge, are disclosed as beneficial and essential to the extent that proper mixing is achieved. Proper mixing presumably means that the sludge and dilution water are in such close association that samples taken anywhere in the mixture all would contain essentially the same amount of water. In contrast, as used herein, high-shear agitation refers to a degree of turbulence significantly greater than that required for mere mixing.

SUMMARY OF THE INVENTION

Present invention is a method for processing sludge formed in a retention pond used to store tailings obtained from the water extraction of bitumen from tar sands. The method involves removing sludge from a retention pond and adding to the sludge sufficient water to dilute the sludge whereby when the resulting mixture is concurrently subjected to high-shear agitation and aerated, the separation of bitumen from the sludge is enhanced. The enhancement can result in greater % bitumen recovery and in a shorter period of time necessary to treat the sludge. The sludge so diluted can contain additives which also can facilitate the separation of bitumen. The resulting froth, produced as a result of the aeration and agitation and containing bitumen, is separated from the treated mixture and can be processed in a similar manner to the froth obtained in the primary and scavenger steps.

DESCRIPTION OF THE DRAWING

The attached drawing is a schematic representation of one of applicants' embodiments as it relates to a hot water extraction process.

DETAILED DESCRIPTION

Referring now to the single FIGURE, tar sands are fed into the system through a line 1 and pass to a conditioning drum (or muller) 30. Water and steam are introduced to the drum 30 through another line 2. The total water so introduced in liquid and vapor form is a minor amount based on the weight of the tar sands processed. The tar sands conditioned with water, pass through a line 3 to the feed sump 31 which serves as a zone for diluting the pulp with additional water via line 20 before passage to the separation zone 32. The additional water may be clear pond water.

The pulp tar sands are continuously flushed from the feed sump 31 through a line 4 into separator zone 32. The settling zone within the separator 32 is relatively quiescent so that bitumen froth rises to the top and is withdrawn via line 5 while the bulk of the sand settles to the bottom as a tailings layer which is withdrawn through line 6.

A middlings stream is withdrawn through line 7 to be processed as described below. Another middlings stream, which is relatively bitumen-rich compared to the stream withdrawn through line 7, is withdrawn from the unit via line 8 to a flotation scavenger zone 33. In this zone, an air flotation operation is conducted to cause the formation of additional bitumen froth which passes from the scavenger zone through line 9 in mixture with the primary froth from the separator 32 to a froth settler 34. A bitumen-lean water stream is removed from the bottom of the scavenger zone 33 through line 10 to be further processed as described hereinafter. In the settler zone 34, some further bitumen-lean water is withdrawn from the froth and removed through line 11 to be mixed with the bitumen-lean water stream from the flotation scavenger zone 33, the sand tailings stream from the separation zone 32 and a portion of the lower middlings withdrawn via line 21 from the separation zone 32. The bitumen froth from the settler 34 is removed through line 12 from further treatment.

The bitumen-lean water from the froth settler 34, the scavenger zone 33 and the separator 32, all of which make up a tailing discharge stream, which can be collected and handled via a dike building or overboarding operation previously described. The tailing discharge stream, via line 13, can be fed to distribution pipe 14. The distribution piping provides for continuous and uniform delivery of the effluent 15 to the pond 35. The latter can be considered another separation zone; it is a zone of quietness. Both the dike building and overboarding operation result in what is commonly referred to as a pond, particularly a retention pond. And as previously described three layers are formed in the pond. They are (1) a top water layer relatively free of clay and bitumen and which can be recycled; (2) a middle layer consisting of bitumen and mineral (defined as not being soluble in toluene); and (3) a bottom layer having a relatively high concentration of sand. The middle layer is often referred to as sludge.

The sludge is continuously being formed in a time span of many months and even years. As a result its characteristics are different than those of the middlings layer drawn off from the separation zone 32 via lines 7 and 8. Some of the differences include that the middlings layer has a higher pH (e.g., about 8.4) whereas the sludge can have a lower pH (e.g., about 7.4). The differences in pH reflect changes which are not fully understood but which are occurring in the pond. Another difference between the sludge and middlings streams (via lines 7 and 8) is the weight percent of mineral, e.g., the middlings stream contains about a lower 8–12 wt.% whereas the sludge contains a higher weight %.

Applicants' improved method involves withdrawing sludge from the pond 35 by known means, for example, line 16 which opening is maintained in the sludge layer and which line is attached to suction pump 36. Line 17 from the latter, carries the sludge to treating zone 37. In applicants' method an effective amount of water is admixed with the incoming sludge 17 or added to treating zone 37. The water can be added to the treating zone 37, e.g., via line 18. Other combinations can be used. Also present in the treating zone can be additives which also enhance the recovery of bitumen from sludge. The resulting froth containing bitumen can be separated and forwarded to final processing via line 19 while the remaining material can be returned to the same pond or a different pond (not shown) via line 20.

The high-shear agitation within treating zone 37 can be by known means (not shown) while the aeration (not shown) also can be by known means such as forcing air through a porous pipe in the bottom of the treating zone 37. Other alternatives and combinations are known to those skilled in the art. The amount of high-shear agitation and aeration can vary over a wide range with economic considerations suggesting that the minimum necessary to achieve the desired separation of bitumen is preferred. Further the amount of agitation and aeration may vary depending, in part, on how much additional water is used. However in present invention agitation and aeration are used concurrently and cause a turbulence of the sludge and dilution water which exceeds mere mixing wherein the object is to obtain uniform composition. Generally the high-shear agitation used to practice the invention can be at a suitable Reynolds Number for a particular unit, however, preferably the Reynolds Number would be higher than 10,000, more preferably higher than 100,000.

The amount of water admixed with the sludge, prior to processing it for bitumen recovery, is sufficient to dilute the sludge whereby the removal of bitumen from the sludge is enhanced. Also, the amount can vary depending in part on the particular properties of the particular sludge undergoing treatment. The properties of the sludge change as a result of changes in the water extraction treatment of the tar sands. Because of the large size of the ponds any change in the pond is gradual. Also the amount of dilution water can vary depending on the kind and duration of the high-shear agitation and aeration. Generally the amount of water added will be that which reduces the viscosity of the sludge sufficiently to give an increase in % bitumen recovered and decrease the time required for the froth to separate. Preferred ranges of dilutions are between about 1 part water to 10 parts sludge and about 2 parts water to 1 part sludge. Further, economics suggest that the amount is the smallest possible consistent with the value of the additional bitumen recovered offset by the additional costs associated with the handling of the additional water. The water used could be clear pond water or fresh water, or some other suitable water.

After the mixture of sludge and dilution water, for example, have been sufficiently agitated and aerated the froth containing the bitumen is separated from the remaining material. The means for separation are not shown. The treated sludge could be transferred to a settling zone (not shown) wherein the froth is permitted to separate. In such a settling zone two layers are formed, an upper bitumen froth layer reduced in mineral matter and water and a lower layer comprised substantially of mineral matter and water with minor amounts of bitumen therein. The separated froth, (upper layer) could be fed via line 19 to the froth settler zone 34, admixed with the separation zone froth and thus processed in the same manner as the froth obtained from the separation zone 32. An alternative could be to bypass the froth settler zone 34 and feed into line 12. The remaining material, (lower layer) that is the tailings containing water and the mineral obtained as a result of the contacting in treating zone 37 can be returned via line 20 to pond 35 or a different pond (not shown).

The result of treating the sludge by applicants' method is that the amount of bitumen remaining in the tailings from treating zone 37 is substantially reduced. Advantages of applicants' method include the fact that more bitumen is ultimately recovered from the tar sands and the amount of tailings requiring storage can be reduced. Both of the foregoing economically enhance the tar sands operation.

Essentially the present invention comprises diluting sludge with water and subjecting the diluted sludge to high-shear agitation and aeration, and settling the resulting sludge to obtain an upper bitumen-containing froth layer and a lower sludge layer reduced in bitumen content, whereby the recovery of the bitumen is greater than that obtained with aeration and mixing with mild agitation or with aeration alone or with agitation alone. The method can further involve that during the high-shear agitation and aeration an alkali metal silicate is present. The method can also further involve that present during the high-shear agitation and aeration is an additive selected from the group consisting of phosphates, creosotes, phenols, phenol derivatives, starches, modified starches, lignin sulfonates and polycarboxylates. In addition the dilution used in the method can range between about 1 part water to 10 parts sludge and about 2 parts water to 1 part sludge.

The following examples illustrate the invention. Comparative examples are also given.

EXAMPLES

Sludge used in the following examples analyzed as follows: bitumen-6 wt.%; mineral-22 wt.%; water-72 wt.%. The sludge had a pH of 7.1.

In batch 1 a container was charged with sludge, sealed and then pressurized to 50 psig with air. The pressurized container was shaken for about 5 minutes by hand. Then the pressure was released and the container allowed to rest for a few minutes. Any froth was skimmed off and analyzed. As can be seen from the accompanying Table I, very little froth was produced and not much bitumen was recovered. This provides one standard by which the other runs were compared.

Batch 2 runs indicate the effect of dilution water. The charge in batch 2 runs consisted of equal weight of sludge and pond water (top, clear layer of pond). In run 2A the resulting charge in a vessel was gently stirred by use of a spatula. As can be seen from Table I a small amount of froth was produced (compared to 1) and little bitumen was recovered. Run **2*a* is a demonstration of what the result would be if mere mixing was used in contrast to the agitation and aeration produced by means described hereinafter. In run 2*b* the vessel containing the charge was pressurized with 50 psig air and then shaken for about five minutes. By comparison with run 1, run 2*b* resulted in a substantial increase in the amount of froth as well as the % of bitumen recovered. In run 2*c* the charge was agitated and aerated by use of a standard flat bladed turbine turning (in a baffle vessel) at 2000 rpm for 3 minutes. ("Standard" is a word recognized by a person skilled in the art of mixing and refers to the size and ratio of blades and baffles size). The amount of froth produced was increased compared to all the other runs of batch 2 and the % of bitumen recovered also increased substantially to run 2*b*. Thus runs 1 through 2*c*** show that dilution of sludge with water increases the % of bitumen recovered. It also indicates that the degree of agitation can effect the amount of froth produced and the % bitumen recovered.

Batch 3 runs were performed to indicate the effect of the duration of agitation and aeration on the separation of bitumen. Batch 3 runs were performed in a Western Machinery flotation cell (also referred to as a Wemco Cell). The cell consists of a vessel and means for agitation and aeration. The means for agitation are located about $\frac{2}{3}$ down inside the vessel. The agitation means consist of two parallel plates connected by a series of rods located toward the outer edges, the effect being that of a cage. Inside the outer cage is a similar but smaller cage which is turned by a hollow shaft which goes upward through the outer plate and is connected to a power source which rotates the inner cage. The outer cage is connected to the shaft and the inner cage so that when the inner cage rotates the outer one remains stationary. The net effect is a high shear agitation. The hollow shaft provides the means for passing air, or other gases, down into the material being agitated. The charge to the cell was equal weights of sludge and distilled water. The duration of the treatment in the cell range from 1 hour to 12 minutes. As the duration of the treatment increased the amount of froth increased as well as the % bitumen recovered. Further comparison of the runs of batch 3 with runs 2*b* and 2*c* indicated that while substantially less froth was produced in the cell, the % bitumen recovered, particularly compared to run 2*c*, was, with greater durations of treatment in the cell, better.

Batch 4 runs indicate that the amount of dilution water can affect production of froth and % bitumen recovered. In batch 4 the charge consisted of 68 wt.% sludge and 32 wt.% pond water. Run 4*a* was performed using a turbine (2000 rpm) for 45 minutes. The result, relative to run 2*c*, was less froth and less % bitumen recovered, despite the additional duration of treatment. In run 4*b* a Wemco Cell was used for 45 minutes, 5 minutes longer than run 3*b*, yet while froth production increased, % bitumen recovered did not. On the whole batch 4 runs, relative to the previous runs, suggests that the amount of water used to dilute the sludge is an important variable.

Batch 5 runs further indicate that the amount of dilution water can affect production of froth and % bitumen recovered. In batch 5 runs a turbine operating at 2000 rpm was used for a duration of 10 minutes. In run 5*a* the charge was 87 wt.% sludge and 13 wt.% pond water; and in run 5*c* no dilution water was used. Runs 5*a* and 5*b* both, compared to runs 2*c* and 4*a*, indicated that both froth production and % bitumen recovered are decreased. Run 5*c* indicates that using a turbine with 100% sludge results in a lot of froth but apparently no enrichment as to bitumen.

TABLE I

Flotation of Bitumen from Sludge

| Batch | Treatment of Sludge | % Crude Froth[a] | % Bitumen Recovered[b] |
|---|---|---|---|
| 1 | Pressurized with 50 psig air and then shaken | 2.5 | 4 |
| 2 | Dilute 50% by weight with pond water, then | | |
| | a. mix by gentle stirring | 0.6 | 5 |
| | b. pressurize with 50 psig air and then shaken | 13.9 | 34 |
| | c. stir with turbine, 2000 rpm, 3 minutes | 28.8 | 79 |
| 3. | Dilute 50% by weight with distilled water, then | | |
| | (a) Wemco Cell, 12 min. | 6.3 | 72 |
| | (b) Wemco Cell, 22 min. | 7.6 | 75 |
| | (c) Wemco Cell, 40 min. | 9.1 | 79 |
| | (d) Wemco Cell, 1 hour | 9.6 | 84 |
| 4. | Dilute 32% by weight with pond water, then | | |
| | (a) stir with turbine, 2000 rpm, 10 min. | 26.8 | 65 |
| | (b) Wemco Cell, 45 min. | 13.8 | 75 |
| 5. | Turbine, 2000 rpm, 10 min. | | |
| | (a) 80% sludge + 20% pond water | 16.9 | 31 |
| | (b) 87% sludge + 13% pond water | 13.7 | 28 |

TABLE I-continued

Flotation of Bitumen from Sludge

| Batch | Treatment of Sludge | % Crude Froth[a] | % Bitumen Recovered[b] |
|---|---|---|---|
| | (c) 100% sludge | very high* | — |

[a]% crude froth is the weight of froth produced divided by weight of charge times 100.
[b]% bitumen recovered is the weight of bitumen contained in the froth divided by the weight of bitumen in the charge times 100.
*Froth had about same consistency as the sludge so little or no enrichment could have occurred.

In another embodiment of applicants' method another sludge, analyzed, as follows: bitumen-6wt.%, mineral-30 wt.%, and water-64 wt.%, was used. The sludge had a pH of 7.3 and was very thick. The sludge was charged to a Wemco cell and aerated and agitated. Mixing was poor, particularly along the edges. The addition of 100 ppm of sodium silicate to the sludge improved the mixing somewhat but the flotation of the bitumen was slow. Sodium silicate is a known additive for enhancing recovery of bitumen from sludge. The sludge containing 100 ppm sodium silicate (an alkali metal silicate) was thinned by adding 1 part by weight of pond water to 6 parts by weight of sludge was charged to the cell. The cell was operated for various periods. The results are reported in Table II.

TABLE II

Use of Additional Water Reduces Time Required to Process Sludge

| Run No. | Time-Min. | Wt % Bitumen Recovered from Sludge: No Additional Water | Wt % Bitumen Recovered from Sludge: Additional Water Used |
|---|---|---|---|
| 1 | 10 | — | 48 |
| 2 | 20 | — | 73 |
| 3 | 30 | 26 | — |
| 4 | 55 | 60 | — |
| 5 | 68 | 71 | — |
| 6 | 68 | 78 | — |

The data in Table II indicates that the dilution of this sludge enhanced bitumen separation substantially. After 20 minutes of agitation and aeration the amount of bitumen recovered via the use of additional water was 73 wt.% whereas it was only after 68 minutes that about the same amount, 71–78%, of bitumen was recovered. Use of additional water decreased substantially (by one-third) the time needed to recover about the same amount of bitumen. This has the advantage of reducing the size of the equipment necessary to handle the sludge. While sodium silicate was used other additive such as phosphates, creosotes, phenols, phenol derivatives, starches, modified starches, lignin sulfonates and polycarboxylates can be used with similar results.

Similar results as to reduction in time and increase in % bitumen recovered are obtained when dilutions, other than those previously mentioned, are used.

We claim:

1. The method of recovering bitumen from a sludge obtained from a retention pond containing tailings from the water extraction of tar sands, which comprises diluting the sludge with water, wherein the dilution range is between about 1 part water to 10 parts sludge and about 2 parts water to one part sludge, subjecting the diluted sludge to high-shear agitation and aeration, wherein during the high-shear agitation the diluted sludge is experiencing a Reynolds Number in excess of 10,000 and settling the resulting sludge to obtain an upper bitumen-containing froth layer and a lower sludge layer reduced in bitumen content, whereby the recovery of bitumen is greater than that obtained with aeration and mixing with mild agitation or with aeration alone or with agitation alone.

2. Method according to claim 1 wherein during the high-shear agitation and aeration an alkali metal silicate is present.

3. Method according to claim 1 wherein during the high-shear agitation and aeration an additive selected from the group consisting of phosphates, creosotes, phenols, phenol derivatives, starches, modified starches, lignin sulfonates and polycarboxylates is present.

* * * * *